US005537921A

United States Patent [19]

Adner et al.

[11] Patent Number: 5,537,921

[45] Date of Patent: Jul. 23, 1996

[54] PAD PRINTING SYSTEM AND PROCESS OF PRINTING

[75] Inventors: Benjamin S. Adner, Swampscott; Donald P. Bouchard, Peabody, both of Mass.

[73] Assignee: Autoroll Machine Corporation, Middleton, Mass.

[21] Appl. No.: 300,756

[22] Filed: Sep. 6, 1994

[51] Int. Cl.[6] ..... B41F 17/00

[52] U.S. Cl. ..... 101/35; 101/44

[58] Field of Search ..... 101/35, 41–44, 101/163, 364, 318, 333, 335, 338, 340, 341, 389.1

[56] References Cited

U.S. PATENT DOCUMENTS

| | | | |
|---|---|---|---|
| 3,824,927 | 7/1974 | Pugh et al. | 101/389.1 |
| 4,144,108 | 3/1979 | Gidley et al. | 101/389.1 |
| 4,308,793 | 1/1982 | Schmidt | 101/44 |
| 4,314,504 | 2/1982 | Combeau | 101/41 |
| 4,445,998 | 5/1984 | Kanda et al. | 264/385 |
| 4,905,594 | 3/1990 | Phillip et al. | 101/163 |
| 5,134,932 | 8/1992 | Fujino | 101/44 |
| 5,222,433 | 6/1993 | Philipp | 101/163 |
| 5,272,973 | 12/1993 | Chojnacki | 101/44 |
| 5,363,761 | 11/1994 | Galassi | 101/163 |

FOREIGN PATENT DOCUMENTS

| | | | |
|---|---|---|---|
| 2205430 | 6/1981 | Germany | 101/163 |

*Primary Examiner*—Edgar S. Burr
*Assistant Examiner*—Anthony H. Nguyen
*Attorney, Agent, or Firm*—Herbert L. Gatewood

[57] ABSTRACT

A pad printing apparatus is provided with a sealed ink cup for the printing of long images having a length greater than the diameter of the ink cup. The ink cup is caused to move lengthwise of the image and the movement of the image transfer pad is in a direction perpendicular to the lengthwise direction of the image.

13 Claims, 3 Drawing Sheets

PAD PRINTING SYSTEM AND PROCESS OF PRINTING

BACKGROUND OF THE INVENTION

1. Field of the Invention

This invention relates to pad printing and, in particular, to a pad printing system and apparatus for the printing of long images with a sealed ink cup. Even more particularly, the invention relates to an apparatus for pad printing in which the image printed has a length greater than the diameter of the ink cup being used.

2. Description of the Prior Art

The so-called "pad printing," of substrates with an image, in particular those with irregular surfaces, has long been known. In earlier days, at least in some forms of pad printing, the ink was contained in an ink tray which was exposed to the atmosphere. As the ink is solvent based, the solvent or thinner would evaporate, and over time the viscosity of the ink would increase.

In more recent years, the source of ink in pad printing systems for the printing of an image is a reservoir member having the shape of a cup turned upside down. Illustrative of such cups are those disclosed in U.S. Pat. Nos. 5,003,872 and 5,237,922 and the cup disclosed in European Patent Application No. 93201027.5. Such an ink cup, in general, is passed over a printing plate or member having a top planar surface in which a pattern or image is provided, e.g., a line of print. As the cup passes or travels over the pattern in the printing plate, the pattern is flooded with ink. At the same time that the pattern is flooded with ink, at least in some cases, a rim or lip of the ink cup acts as a doctor blade and wipes off any excess ink from the image pattern surface, leaving ink only in the grooves forming the pattern. The ink pattern is then, in general, transferred to a flexible silicone pad or transfer member placed in pressure contact with the image. The transfer pad is then removed from contact with the printing plate and placed in pressure contact with the surface to be printed, e.g., the surface of a catheter in the case of line printing or the surface of a golf ball in the case of logo printing, and the image is thus transferred to that surface. Meanwhile, the image on the printing plate is again inked. The pad is removed from contact with the surface just printed and returns to its home position for placement in contact again with the inked image on the printing plate. Thus, the image is transferred or pad printed onto the second of the items to be printed. This cycle continues until all the items to be printed with the image have been printed.

In pad printing systems wherein a sealed ink cup was used prior to the invention disclosed herein, the ink cup generally moves across the image to be printed, i.e., in a direction perpendicular to the length of the image. The transfer pad travels in the same direction. Nevertheless, in some pad printing systems, the ink cup is held stationary and the printing plate is moved in an in and out manner relative to the ink cup. Regardless of which system is used, however, the transfer pad moves in an up and down manner and in the same in and out direction as earlier disclosed. In such pad printing systems, however, the length or width of an image that can be printed onto a substrate is somewhat limited. This, of course, is due to the fact that the image size is limited by the diameter of the ink cup being used. The image to be flooded with ink can be of no greater length than such a diameter; otherwise a part of the image will not be inked.

In general, with present pad printing systems, the greater the length or width of image to be printed, the larger must be the diameter of the ink cup used. Thus, theoretically, almost any length image could be printed provided the ink cup diameter is large enough. Nevertheless, providing ever larger diameter ink cups for printing longer, narrow images does not offer a practical solution for a number of reasons. With a round ink cup, the stroke of the ink cup must be at least twice the diameter of the cup. This being so, the use of larger diameter ink cups requires larger more expensive printing apparatus including larger printing plates. Moreover, larger diameter ink cups and printing plates are not only more expensive, they are also difficult to make. Larger pneumatic and other operating components are required with larger printing apparatus. A larger diameter cup not only requires greater ink consumption but results in wasted ink. And, a larger diameter ink cup requires a larger plate size resulting in much wasted material. None of this is desirable, however, as such larger apparatus will require a greater amount of floor space than may be available or desired to give up for such a purpose. Moreover, also of concern, are safety considerations, as well as the difficulty and inconvenience experienced by an operator in loading the printer for use.

Thus, there is a real need for pad printing apparatus wherein an image can be printed with a sealed ink cup of greater length than can now be printed. Moreover, there is a need for pad printing apparatus that can print images of greater length than the diameter of the ink cup, yet be no larger in size than pad printing apparatus now used.

SUMMARY OF THE INVENTION

Therefore, a primary object of the invention is to provide a pad printing system in which images of greater length can be printed than now printed with sealed ink cups.

It is a further object of the invention to provide apparatus and a process for pad printing wherein images or patterns can be printed of greater length than the diameter of the ink cup being used in the printing apparatus.

Another object of the invention is to provide pad printing apparatus wherein long images can be printed, particularly in the case of line printing.

It is still another object of the invention to provide pad printing apparatus for the printing of long images where the apparatus is of compact design and requires the use of ink cups having diameters no greater than such cups now being used.

A further object of the invention is to provide pad printing apparatus wherein the ink cup is moved in a linear direction that is lateral, i.e., perpendicular, to the straight line direction of movement of the ink or transfer pad.

It is another object of the invention to provide pad printing apparatus wherein the apparatus comprises means for rapid and easy changeover of one printing plate for another.

It is even a further object of the invention to provide means for preventing the rotation of the ink cup as it translates across the image pattern in the flooding stroke.

It is yet a further object of the invention to provide a process for the pad printing of substrates with an image pattern having a greater length than the diameter of the ink cup being used in the printing process.

Quite advantageously, the apparatus of the invention occupies a no greater foot print than pad printing apparatus now being used, even though the image printed by this invention can be of much greater length than images printed by pad printers heretofore.

Of advantage also is that not only can greater length images be printed according to the invention, the greater length images can be printed with printing apparatus of a somewhat lower cost, using ink cups, pads, and printing plates of lower cost.

A further advantage of the invention is that such allows for faster printing of images by pad printing as the length of stroke of the transfer pad can be shortened.

A still further advantage of the invention is that the ink is prevented from drying out by the speed of travel back and forth of the sealed ink cup over the image pattern by means of an adjustable timing sequence in the printing process.

These, and other objects, features, and advantages of the invention will become more readily apparent to those skilled in the art after reading the ensuing description of a nonlimiting illustrative more preferred embodiment of the invention while referring to the accompanying drawings and the appended claims.

BRIEF DESCRIPTION OF THE DRAWINGS

In order that the present invention may be more readily and fully understood it will now be described, by way of example, with reference to the accompanying drawings, in which.

DETAILED DESCRIPTION OF THE INVENTION AND THE PREFERRED EMBODIMENTS THEREOF

Although the present invention will be described hereinafter with particular reference to the accompanying drawings, it is to be understood at the outset that it is contemplated that the invention may be varied in specific detail from that illustrated and described herein while still achieving the desirable characteristics and features of the invention. Accordingly, the description of the invention which follows is intended to be an enabling disclosure directed to those persons skilled in the art to which the invention pertains, and is not to be understood as being restrictive.

Figure 1:
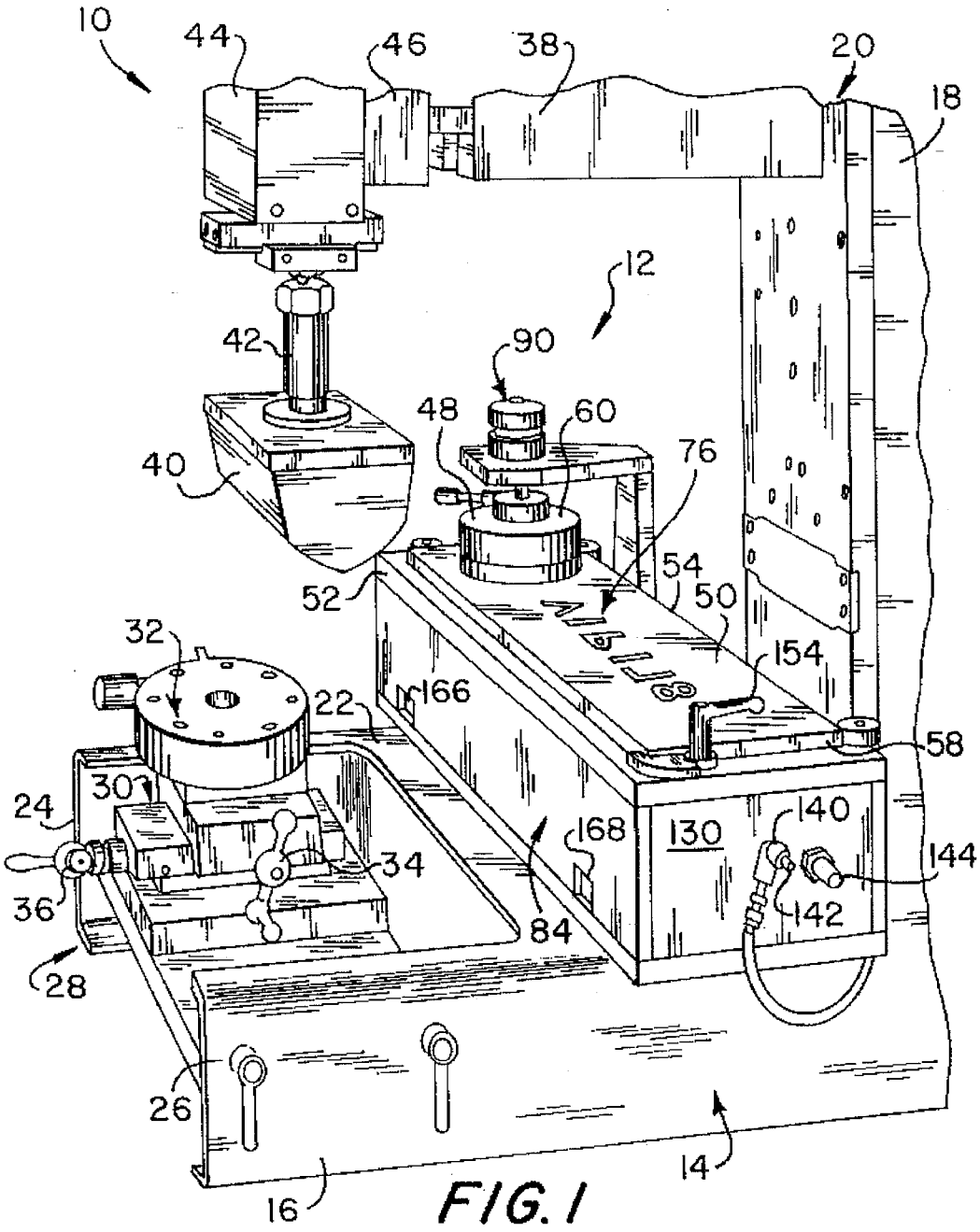
FIG. 1 is a schematic view in perspective of pad printing apparatus according to the invention.

Turning now to FIG. 1 of the drawing there is shown therein a pad printing system or apparatus 10 in accordance with the invention. As will be seen from FIG. 1, the pad printing apparatus 10 comprises an ink cup means 12 supported by a platform means 14 which comprises a horizontally disposed platform 16 and vertically disposed member 18 integral therewith. The vertically disposed member 18 is defined by a top end 20. The platform 16 is defined by a horizontally disposed planar surface 22, elongated parallel side edges 24,26 and a front end 28.

The front end of the platform 16, as shown in FIG. 1, is of a U-shape formed by the extensions of the side edges 24,26 providing a horizontally disposed opening 30. In opening 30 there is located a conventional mounting means 32 for a substrate (not shown in the drawing) whose surface is to be printed with an image. The mounting means 32 is provided with handle members 34,36, according to usual manner, for fine adjustment of the location of the substrate to be printed.

At the top end 20 of the vertically disposed support member 18 there is provided means of conventional design, shown generally by reference numeral 38, for the mounting of the print head and the ink transfer pad 40, as now conventionally done. Thus, the ink transfer pad 40 is capable of movement vertically downwardly and upwardly during a printing cycle, as well as in back and forth lengthwise direction of the platform 16 to pick up the inked image pattern from the printing plate and to transfer it to the object to be printed. The flexible transfer pad 40 is connected to the bottom end of vertically disposed elongated shaft 42, the top end of the shaft 42 (not shown in the drawings) being operatively connected in usual manner to means or pad head 44 for providing vertical up and down movement to the shaft 42, hence to transfer pad 40. The pad head 44 is, in turn, connected according to usual technique to the front end of horizontally disposed member or pad carriage 46, the back end (not shown) of which is connected to conventional means for providing predetermined linear movement of the transfer pad 40 in a direction lengthwise of the platform 16.

Figure 2:
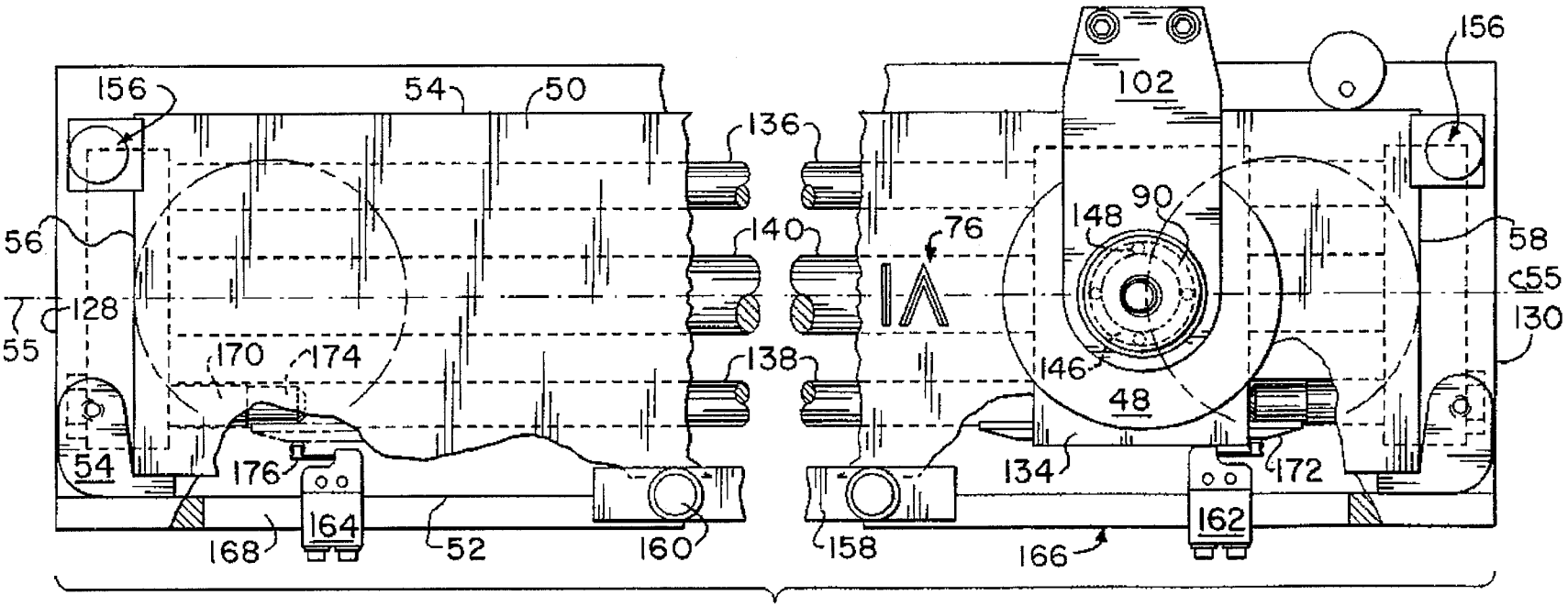
FIG. 2 is a top plan view showing a pattern or printing plate for use in the invention in which is provided grooves making up a desired pattern or image to be printed on a substrate in operative combination with an ink cup which provides ink to the pattern grooves and the means for translating the ink cup over the pattern to flood it with ink.
Figure 3:
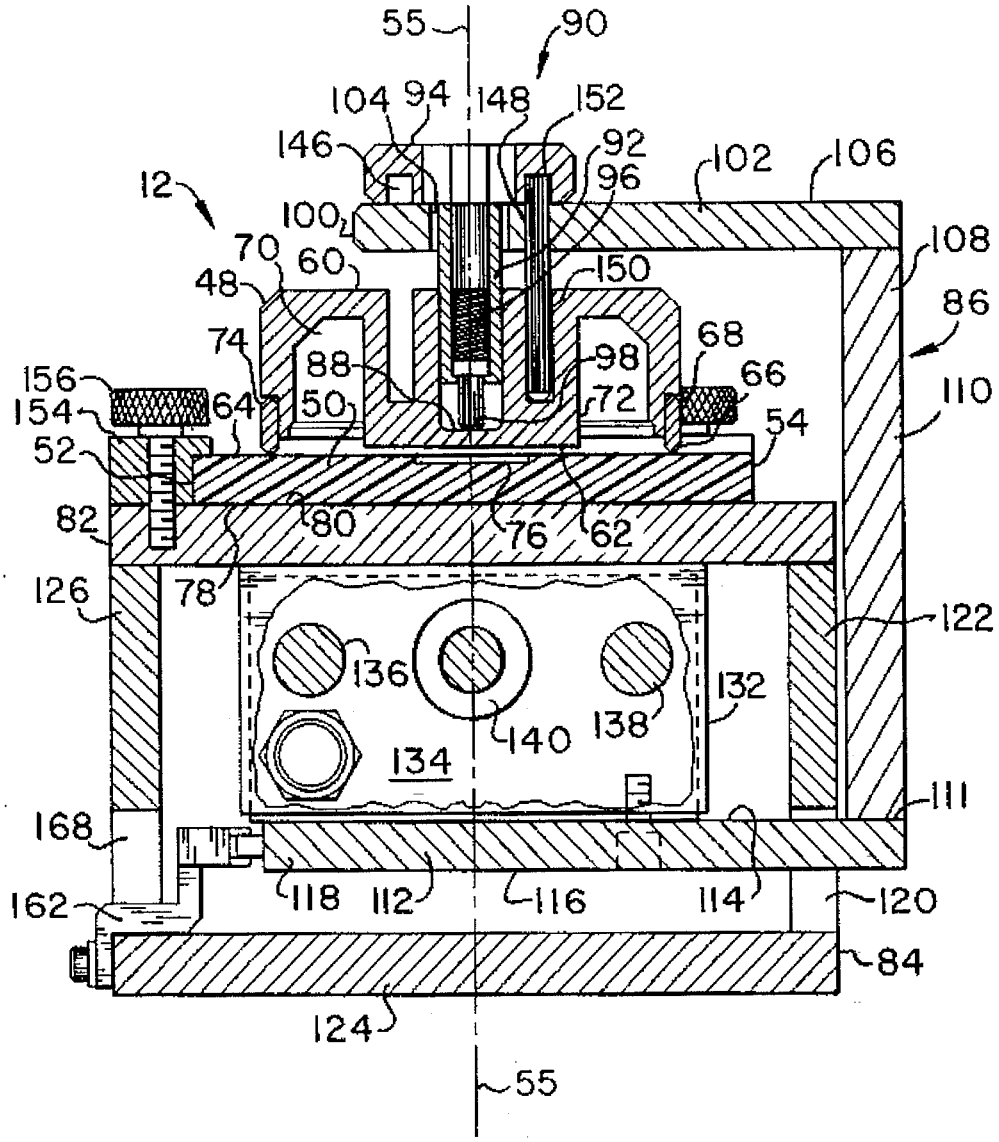
FIG. 3 is a view in cross-section of a printing plate and ink cup and the translation means therefor shown in FIG. 2 taken from the right end of that figure with the ink cup at the end of an inking stroke.

The ink cup means 12, as best seen in FIG. 3, comprises an ink cup or fountain 48 in operative engagement with a horizontally disposed printing plate or pattern member 50. The plate 50 used in the practice of the invention, as best seen in FIG. 2, is of a rectangular shape; however, this need not necessarily be the case. The rectangular-shaped printing plate 50 is defined by front and rear edges 52,54 and parallel, spaced-apart, elongated end or side edges 56,58.

The ink cup 48 is of a circular-shape (see FIG. 2) of predetermined diameter and is defined by a horizontally-disposed, planar, top surface 60 and a horizontally-disposed, planar bottom surface 62. The bottom surface is of circular shape, and, importantly, not in contact with the top planar surface 64 of the printing plate 50. The ink cup 48 is open at its bottom end providing an ink cup or well having the shape of an inverted cup. Thus, as seen from FIG. 3, there is provided a reservoir 70 for ink surrounding the centrally disposed body member 72. The ink cup is further defined by an annular-shaped, detachable rim 74, all as shown in European Pat. Appln. 93201027.5 (Publication No. 0568 133 A1), the disclosure of which is fully incorporated herein.

The bottom and top edges 66,68 of rim 74 are generally of a "V" shape thereby providing tapered surfaces terminating in a flat bottom and top surface, as shown in FIG. 3. The bottom surface of the rim 74 is in contact with the top surface 64 of the printing plate 50. Thus, as will be readily appreciated, the bottom surface of the rim 74 not only acts to provide good sealing contact with the printing plate but it also functions as a doctor blade to remove any excess ink from the plate surface, leaving ink only in the grooves forming the image or pattern to be printed, later more fully described. The rim 74 is of a ceramic material such as a zirconia-containing material, providing good wearing characteristics to the doctor blade or rim. Of advantage in the use of such an ink cup is the fact that the rim 74 acts to doctor the excess ink from the printing plate surface simultaneously with the image being flooded.

Although not shown in the drawings, a plurality of magnets are provided in the body member 72, these terminating in the planar bottom surface 62 of the ink cup 48. Thus, the ink cup will be attracted to the top surface 64 of the printing plate 50 and pulled downwardly in contact therewith providing good sealing engagement between the bottom surface 66 of rim 74 and the top surface 64 of the printing plate. This being the case, no ink will escape from the ink cup nor will the thinner evaporate from the ink. The viscosity of the ink, as a result, will be maintained more uniform. To accomplish such a result, however, as will be appreciated, the flatness of the top surface of the printing plate traveled by the ink cup is of key importance. It has been discovered in the practice of the invention that the flatness relationship of the rim 74 to the top surface of the thick steel printing plate should be as small a difference as possible, most desirably ±0.0005 inch. Thus, the greater the flatness of the top surface of the printing plate, the greater will be the performance of the ink cup 48 in preventing escape of ink and evaporation of solvent into the atmosphere.

As can be seen from FIG. 3, the circular-shaped ink cup 48 is located inwardly from the respective front and back edges 52,54 of the printing plate equidistantly. Thus, the center point of the ink cup will travel along an imaginary centerline 55 extending the length of the printing plate 50 from end 56 to end 58 thereof. This need not, however, necessarily be the case but such a feature allows for ready use of printing plates wherein the image is provided in the printing plate equidistantly from the front and back edges no matter what its length.

In the top planar surface 64 of the printing plate 50 there are provided grooves defining the image to be printed on the substrate, these grooves being indicated generally by reference numeral 76. The grooves 76 can be provided in the plate by well-known techniques, e.g., engraving. The bottom planar surface 78 of the printing plate 50 which is parallel to top surface 64, as shown in FIG. 3, is in contact with and supported by the top planar surface 80 of the rectangular-shaped top member 82 of housing 84 in which is located ink cup translation device identified generally by reference numeral 86, which will be described more fully hereinafter.

Provided centrally in the ink cup 48 and extending vertically downwardly from the top surface 60 of the ink cup is a dead bore 88 (FIG. 3). The dead bore 88 is provided in the centrally disposed body member 72 of the ink cup 48, and is provided centrally therein. In dead bore 88 there is located a plunger or pressure adjusting member 90 comprising an elongated shaft 92 which extends vertically downwardly from a circular-shaped knob 94 and which is integral therewith. The knob, as is conventionally done, is provided with a knurled peripheral surface to aid in the turning of the shaft. In the bottom end of the shaft 92 there is provided a spring loaded member 98 comprising spring member 96 the function of which is to exert a downward force on the base of the dead bore. Thus, the pressure contact between the pattern or ink plate 50 and the ink cup 48 can be adjusted to provide more or less pressure, as desired. In the body member 72, as earlier disclosed, there are located magnetic inserts for providing good sealed engagement between the ink cup and the printing plate top surface 64.

Connected to the ink cup 48 by means of the pressure adjusting member 90 is the inner end 100 of the top horizontally disposed elongated member 102 of the low profile cup slide member of the ink cup translation means 86. The inner end 100 is provided with a circular-shaped opening 104 through which shaft 92 extends. Opening 104 is provided with an internal thread pattern 96 which is complementary to the external thread pattern (not shown) provided on shaft 92. The outer end 106 of the top elongated member 102 is fixedly connected to the top end 108 of vertically disposed member 110 of the ink cup slide or translation device 86, the bottom end 111 of the member 110 being fixedly connected to the outer end of the bottom horizontally disposed elongated member 112 of the cup slide member.

The bottom horizontally disposed member 112 of the cup slide member is defined by top and bottom planar horizontally disposed surfaces 114,116 and an inner terminal end 118. The horizontally disposed bottom member 112 is located for back and forth movement adjacent its outer end in an elongated slot 120 (FIG. 3) provided in the back wall 122 of the housing 84. The slot 120 extends lengthwise of the housing, the length of the slot being determined, in general, by the length of stroke desired for the ink cup which, in turn, will depend largely upon the length of the image being printed.

The housing 84 is further defined by a rectangular-shaped bottom member 124 spaced apart from the top member 82 a predetermined distance and in parallel disposition thereto, the top and bottom members being connected together by front wall 126 and back wall 122. Connecting the top and bottom members together in fixed relationship, and the front and back walls are end walls 128,130. The two end walls are spaced apart a predetermined distance and with the top and bottom members provide a housing of rectangular shaped cross-section, as is shown in FIG. 3. This rectangular-shaped housing is of no particular consequence, however, to the practice of the invention. The housing could be of square cross-sectional shape, if desired. The top and bottom members of the housing could even, if desired, be of circular shape. Nevertheless, regardless of the shape of the top and bottom members of the housing 84, the front and back walls in the preferred aspects of the invention will be of a rectangular or square-shaped cross-section. This will best simplify providing for the linear movement back and forth of the cup slide member comprising the top and bottom horizontally disposed members and the vertically disposed member 110.

Fixedly connected to the top surface of the horizontally disposed bottom member 112 is a conventional magnetic slide assembly indicated generally by reference numeral 132. Such a slide assembly is commercially available from PHD Incorporated of Fort Wayne, Ind. The magnetic slide assembly 132 comprises a rectangular-shaped saddle or magnetic slide member 134, as is shown in FIG. 3, such being in operative engagement with elongated carriage shafts 136,138 and the magnetic coupling tube 140 for back and forth movement in lengthwise direction of the housing 84. As will be apparent from FIG. 3, the interior dimensions of the housing 84 must be such as to allow the saddle or slide member 134 to be readily moved without restriction a suitable predetermined length from one end of the housing to the other, and then back again, as desired.

The ends of the carriage shafts 136,138 and magnetic coupling tube 140 are supported according to usual technique in the end members 128,130 of the magnetic slide assembly, these end members also serving as the end walls of the housing 84. The center lines of these shafts and the magnetic coupling tube must be in parallel relationship to one another and to the inner surfaces of the top and bottom members of the housing 84. As will be seen from FIG. 1, the end of the magnetic coupling tube 140 and the end of a carriage shaft are fitted with joint members 142,144 which are connected to a source of air via a conventional solenoid valve, neither of which is shown in the drawing. The manner of operation of such a magnetic slide assembly is well known and need not, it is believed, require further description herein. Other magnetic slide assembly that are commercially available can also be used to perform the function disclosed herein. Although the means causing translation of the ink cup, as disclosed, is a magnetic slide assembly, such need not necessarily be the case. Other means for accomplishing this function will be readily known to those skilled in the art, e.g., a stepping motor.

Referring now again to FIG. 3, it will be seen that an annulus 146 is provided in the knob 94 and in the horizontally disposed member 102 of the ink cup slide member there is provided an opening 148, the purpose for which will soon be made clear. In alignment with the opening 148 there is provided dead bore 150 in the ink cup 48. This allows alignment pin 152 to be located in the opening 148 and dead bore 150 thereby, and this is of critical importance, preventing rotation of the ink cup relative to the printing plate during the printing operation. Although in the drawing (FIG. 2) only four openings are seen to be provided in the member 102, a greater number of openings are most preferably provided, these being arranged in a circle with the same centerpoint. The ink cup is desirably provided also with a plurality of dead bores such as that referred to by reference numeral 150; however, there need not necessarily be as many dead bores in the ink cup as openings provided in the horizontally disposed member 102. In preparing the apparatus for printing, an opening 148 provided in the member 102 will be lined up with a dead bore 150 in the ink cup and pin 152 will be inserted. Thus, the location of the ink cup will be locked relative to the printing plate, allowing for no rotation of the ink cup. The plunger or pressure adjusting member 90 will then be threadably connected in top member 102, the annulus 146 extending inwardly from the bottom surface of the knob 94 and lining up with the top of alignment pin 152 thereby allowing the plunger to be seated to the extent desired.

Although, as above disclosed, the knob 90 has been provided with an annulus for the capture of the top end of pin 152, this need not be the case. The knob can, if desired, be provided with a plurality of openings arranged in circular fashion and having a center point that corresponds with the center point of the openings provided in the top member 102 and the ink cup. In this case, the openings in the three members are lined up, and the pin inserted. Then, the plunger is rotated in clockwise fashion to cause it to be threaded into the dead bore 88 of the ink cup to provided the desired pressure. It is, of course, necessary in this case that the pin 152 need be of a length such that the top end thereof clear the opening provided in the knob. Otherwise, it will not be possible to rotate the knob once the pin 152 is inserted.

The printing plate 50, as earlier disclosed, can be, in one aspect of the invention of magnetic material, e.g., a steel plate, so that the magnets (not shown) located in the bottom surface 62 of the ink cup are attracted thereto; however, this need not necessarily be the case. More about this later. In this case, the printing plate is held to the top member 82 of the housing by conventional threaded hold down fasteners or flange members such as referred to generally by reference numeral 154. See FIG. 1. Although only one such a fastener is show in FIG. 1, it will be appreciated that such a fastener is provided at both ends of the printing plate 50. Two such hold down fasteners, one at each end of the printing plate, will generally be sufficient; however, if desired, more of the fasteners can be provided, e.g., one on each front and back edge of the printing plate.

Figure 4:
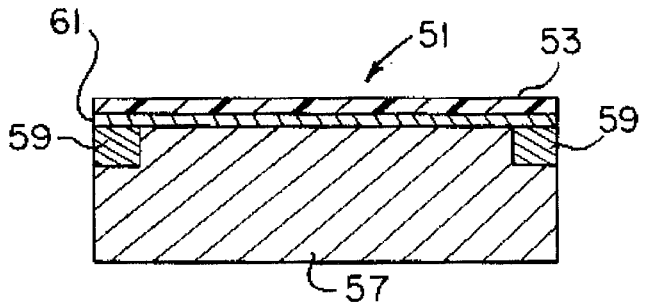
FIG. 4 is a view in cross-section of a printing plate comprising a photopolymer layer laminated to a thin, flexible, steel plate, this lamination being held to a metal support member by magnets.

The printing plate can, if desired, comprise a photo-polymer or plastic material conventionally used in providing image patterns to be printed on a substrate. In this latter case, the printing plate 51 (FIG. 4) comprises a relatively thin plastic film 53 laminated to and supported by a thin, flexible steel plate 61. The photo-polymer printing plate is then supported according to usual practice on the top planar surface of a metal backing or support member 57 of rectangular shape. Along the longer edges of such a backing member are provided a plurality of spaced apart circular-shaped magnets such as identified by reference numeral 59 embedded in the top surface of the backing member. Thus, the flexible steel plate or backing of the photo-polymer printing plate will be held flat and in overall contact with the supporting member. Such a printing plate is further held to the top member of the housing by flange members such as identified by reference numeral 154 (FIG. 3), these members being located, if desired, at the four corners of the photo-polymer printing plate and secured to the top member 82 by conventional screw members identified generally by reference numeral 156. Thus, printing plates offering certain economies over the rigid engraved printing plates can be provided, allowing for a greater variety of images to be printed and at a lesser cost with apparatus of the invention. In some cases at least, it may be desirable to provide further hold down of the photo-polymer printing plate against the support member therefor, particularly, if the printing plate is of a somewhat longer length. Thus, as will be seen by reference to FIG. 2, this can be accomplished by flange members 158 of any length desired, these longer flange members being secured to the support member by conventional threaded fasteners identified generally by reference numeral 160

Referring now to FIG. 2, it will be seen that limit switches 162,164 are provided near the end walls of the housing 84, in openings 166,168. The location of these limit switches, as is commonly done, tells the ink cup when it has reached the end of the stroke desired, i.e., the linear distance that the ink cup will need travel, and when to return. The length of the stroke, of course, depends largely upon the length of the image on the printing plate and can be determined readily by those skilled in the art. The limit switches are triggered, according to usual manner, by means provided on the magnetic slide member on saddle 134, indicated generally by reference 176. The purpose of the limit switches is, of course, to cause reversal of direction of travel of the slide saddle once the ink cup has reached the end of its stroke. Thus, in each stroke back and forth lengthwise of the housing 84, the image or pattern 76 will be flooded with ink and the excess doctored off.

The end of the stroke, i.e., the distance traveled by the ink cup, and the abrupt reversal in the direction of travel is cushioned by cushion means 170,172, as best seen by reference to FIG. 2 of the drawing. These cushion means are commercially available and comprise, in general, a spring loaded flexible end 174 of rubber or the like. Other cushion means know to the art, e.g., air cushioned means, can be used, instead, if desired.

Importantly also in the practice of the invention, the ink cup can be translated at a speed back and forth across the image such that the ink on the image is not allowed to dry out. The travel of the ink cup is timed so that it will travel across the image on the plate at regular intervals when the printer is at rest so that the ink is continuously being mixed. Thus, the image on the plate is lubricated and prevented from drying out. In most cases, the speed of the ink cup should be such as to allow no more than about 3 seconds rest at each end of the stroke. Accordingly, the flooded image will always be wet even though the length of the image is longer than the diameter of the ink cup. The optimum speed and time of travel in any particular case can readily be determined by those skilled in the art.

In the use of a pad printer according to the invention, a printing plate 50 having the desired image 76 provided in its top surface according to usual manner is clamped into operative connection with the top member 82 of a housing 84. Importantly, and this is a unique feature of the invention, the image provided can be of any length desired. And, the width of the image, i.e., the distance from top to bottom, can be of any maximum width corresponding to the diameter of the ink cup.

The housing 84, according to the invention, is mounted such that its centerline is perpendicular to the direction of travel of the ink transfer pad. An ink cup 48 of the desired diameter is then selected and is mounted to the ink cup slide member so as to be in contact with the printing plate as shown in the drawings. The pressure adjusting member 90 is then inserted in the threaded opening provided in the end of member 102. The ink cup is then adjusted so that a dead bore 150 provided in the ink cup is in alignment with an opening in the top member 102 and the annulus of the knob 94. The pin 152 is then inserted. Afterwards, the knob 94 is rotated to compress the spring on spring loaded member 98 so as to obtain the desired contact pressure between the ink cup lip and the top surface of the printing plate. The ink cup is then caused by the magnetic slide translation means to move in a linear direction the desired length of the housing. Thus, the ink cup causes the grooves 76 of the image in the printing plate 50 to be filled with ink while, at the same time excess ink is wiped off the surface of the printing plate by the "V" shaped bottom edge of the rim 74.

When the ink cup has reached the end of its forward stroke, the ink transfer pad is caused to be moved vertically downwardly and placed in pressure contact with the inked image. The transfer pad is then raised vertically upwardly, having picked up the image and is moved forward in a linear direction in a horizontal plane. At the end of its stroke forward, the transfer pad is caused to move vertically downwardly and into pressure contact with the member to be printed with the image. The image is thus transferred to that member's surface. The transfer pad is raised vertically upwardly and caused to move rearwardly in the same horizontal plane as before to its home position. The transfer pad then is ready to repeat its cycle in synchronous manner with the operation of the ink cup.

While the transfer pad is moving forward, the ink cup is caused to be returned to its home or starting end whereby to be ready to repeat the printing cycle to print another substrate. At the time that the ink cup is being returned to its starting position for the second cycle of printing, it again floods the image with ink. The flexible ink transfer pad is placed in pressure contact with the ink-filled grooves in the printing plate, as before, and the image is transferred to the second item to be printed. The ink cup and ink transfer pad, in accordance with the invention, are each caused to be moved in a linear direction that is, and this is of critical importance to the invention, perpendicular to one another, rather than in the same linear direction. The length of an image that can be printed in accordance with the invention is determined only by the length of the stroke of the ink cup in the direction lateral to that of the ink pad and the desired speed of the printing operation.

Various applications will be found for the invention disclosed herein. Typical of these applications include the printing on vacuum cleaner housings and housings for home appliances, graduations on catheter tubes and other medical applications, and automotive bezels. The invention can, in general, be used in the printing of any long images.

Quite advantageously, images as great as five inches in width or height by eighteen inches in length can be readily printed by the invention disclosed herein. Nevertheless, this does not constitute a limitation except for size ink cup most advantageously used in the practice of the invention, ink cups having diameters of, e.g., 60, 90, and 135 mm.

It will be understood that various changes in the details, materials, arrangement of parts, and operational conditions which have been herein described and illustrated in order to explain the nature of the invention and its operation may be made by those skilled in the art within the principles and scope of the invention, Having thus set forth the nature of the invention, we claim:

1. Apparatus for the pad printing of an image of predetermined length and width on the surface of a substrate comprising:

(a) means for holding the substrate whose surface is to be printed with said elongated image while said substrate is being printed;

(b) a horizontally disposed, elongated image pattern member being provided in operative association with the substrate holding means, said image pattern member comprising front and back elongated edges parallel to one another defining the width of the image pattern member and planar top and bottom elongated surfaces in parallel disposition to one another, an elongated image pattern of the same predetermined length and width as the image to be printed being provided in the top planar surface of said image pattern member, said predetermined length of the elongated image pattern being of a lesser length than the elongated image pattern member and extending lengthwise of the elongated image pattern member, said image pattern being located between the front and back edges of the image pattern member, the predetermined width of the image pattern being of a width less than the width of the image pattern member;

(c) a circular-shaped ink cup having a diameter greater than the width of the elongated image pattern and less than the length of the elongated image pattern, the ink cup being defined by a top end and a bottom end, said ink cup having the shape of an inverted cup thereby to provide an open bottom end in opposition to the top planar surface of the elongated image pattern member, a reservoir being provided in the ink cup for holding ink;

(d) an elongated housing being defined by elongated rectangular-shaped top and bottom members in spaced-apart parallel disposition to one another, and spaced-apart, elongated, parallel front and back walls intersecting with the top and bottom members, and spaced-apart, elongated, parallel, end walls interconnected with the top and bottom members and the front and back walls, said elongated housing defining an internal elongated cavity, a planar top surface being provided on the elongated top member of the housing for supporting the elongated bottom planar surface of the image pattern member, an elongated slot of lesser length than the elongated back and front walls of the elongated housing being provided in at least one of said front and back walls and extending lengthwise of the elongated housing, said elongated slot being provided in parallel disposition to the top and bottom members of the elongated housing;

(e) means for translation of the ink cup back and forth in a straight line lengthwise on said top planar surface of the image pattern member and across the length of the elongated image pattern while the elongated image pattern is being flooded with ink, said translation means for the ink cup comprising a vertically disposed elongated member defined by top and bottom ends, a top horizontally disposed elongated member defined by inner and outer ends, the inner end of said top horizontally disposed member being connected to the top end of the ink cup and the outer end of said top member being connected and in perpendicular disposition to the top end of the vertically disposed member, and a bottom horizontally disposed elongated member in the same vertical plane and being in parallel disposition to the top horizontally disposed member, said bottom horizontally disposed member being defined by inner and outer ends, the outer end of the bottom horizontally disposed member being connected to the bottom end of the vertically disposed elongated member, said bottom horizontally disposed elongated member extending through said elongated slot into the internal elongated cavity of the housing, magnetic slide means being provided in the internal elongated cavity of the housing, said magnetic slide means comprising a magnetic slide member being operatively connected to the bottom horizontally disposed member of the translation means for movement of the bottom member back and forth in the elongated slot lengthwise of the housing;

(f) an image transfer pad being operatively supported above the top planar surface of the elongated image pattern member; and (g) means for movement of the image transfer pad in a straight line in a direction perpendicular to the lengthwise direction of movement of the ink cup.

2. Apparatus according to claim 1 wherein means are provided for detachably connecting the elongated image pattern member to the top member of the elongated housing.

3. Apparatus according to claim 1 wherein the elongated image pattern member comprises a sheet-like top layer of a photopolymer laminated to a sheet-like bottom layer of magnetic material.

4. Apparatus according to claim 3 wherein the elongated image pattern member further comprises a support member defined by a top surface and front and back edges for supporting the sheet-like bottom layer of magnetic material and a plurality of magnets being provided in spaced apart locations along the front and back edges of the support member for holding the bottom layer of magnetic material flat against the top layer of the support member.

5. Apparatus according to claim 1 wherein means are provided in operative association with the magnetic slide member in the elongated housing for determining the length of travel of the ink cup.

6. Apparatus according to claim 5 wherein the means for determining the length of travel of the slide member comprises a limit switch located adjacent the ends of the housing which limit switch limits the travel in one direction and causes the slide member to reverse its direction of travel.

7. Apparatus according to claim 6 wherein means are provided on the magnetic slide member for operative association with the limit switch.

8. Apparatus according to claim 1 wherein the elongated image pattern in the elongated image pattern member is located equidistantly between the front and back edges of the image pattern member and a centerline extending between the front and back edges of the elongated image pattern member lengthwise of the top planar surface of the elongated image pattern member divides the elongated image pattern member in half.

9. Apparatus according to claim 8 wherein the elongated image pattern member comprises a steel plate and the elongated image pattern is engraved in the steel plate.

10. Apparatus according to claim 8 wherein the elongated image pattern comprises a plurality of alphanumeric symbols extending lengthwise of the elongated image pattern member, and said centerline of the image pattern member divides the elongated image pattern in half.

11. Apparatus according to claim 8 wherein a diameter of the circular-shaped ink cup coincides with the centerline of the elongated image pattern member.

12. Apparatus for the pad printing of an image of predetermined length and width on the surface of a substrate comprising:

(a) means for holding the substrate whose surface is to be printed with said image while said substrate is being printed;

(b) a horizontally disposed elongated, image pattern member being provided in operative association with the substrate holding means, said elongated image pattern member being defined by front and back elongated edges parallel to one another defining the width of the image pattern member and planar top and bottom elongated surfaces in parallel disposition to one another, an elongated image pattern being provided on the top planar surface of said image pattern member of the same predetermined length and width as the image to be printed, the predetermined length of the image pattern being of lesser length than the elongated image pattern member and extending lengthwise of the elongated image pattern member, said image pattern being located between the front and back edges of the image pattern member, the predetermined width of the image pattern being of a width less than the width of the image pattern member;

(c) an ink cup having the shape of an inverted cup thereby to provide a closed top end and an open bottom end in opposition to the top planar surface of the elongated image pattern member, a reservoir being provided in the ink cup for holding ink and for flooding the image pattern with ink, the open bottom end of the ink cup being of circular-shape and having a diameter greater than the predetermined width of the elongated image pattern and less than the predetermined length of the elongated image pattern;

(d) a circular-shaped rim having a top end and a bottom end being detachably connected to the open bottom circular-shaped end of the ink cup and said bottom end of the circular-shaped rim is provided in contact with the top planar surface of the elongated image pattern member and means is provided for adjusting the pressure of the contact of the circular-shaped rim with the top surface of the elongated image pattern member, said means for adjusting the pressure of the circular-shaped rim against the top planar surface of the elongated image pattern member comprising a rotatable knob having a top surface and a bottom surface, an elongated shaft terminating in a bottom end extending downwardly from the bottom surface of the knob, a spring loaded member being provided in the bottom end of the shaft, an opening being provided in the top member of the translation means, and a dead bore being provided in the closed top end of the ink cup, said shaft extending downwardly through the opening in the top member of the translation means, hence into the dead bore provided in the top end of the ink cup;

(e) an elongated housing being defined by elongated top and bottom members in spaced-apart parallel disposition to one another, and spaced-apart, elongated, parallel front and back walls intersecting with the top and bottom members, and spaced-apart, elongated, parallel, end walls interconnected with the top and bottom members and the front and back walls, said elongated housing defining an internal elongated cavity, a planar top surface being provided on the elongated top member of the housing for supporting the elongated bottom planar surface of the image pattern member, an elongated slot of lesser length than the elongated back and front walls of said elongated housing being provided in at least one of the said front and back walls and extending lengthwise of the elongated housing, said elongated slot being provided in parallel disposition to the top and bottom members;

(f) means for translation of the ink cup back and forth in a straight line lengthwise on said top planar surface of the image pattern member and across the length of the elongated image pattern while the elongated image pattern is being flooded with ink, said translation means being provided in operative combination with the elongated housing;

(g) means for preventing rotation of the ink cup while the ink cup is being translated lengthwise of the elongated pattern member across the length and width of the image pattern;

(h) an image transfer pad for transfer of the elongated image pattern to the substrate to be printed being operatively supported above the top planar surface of the elongated image pattern member; and (i) means for movement of the image transfer pad in a straight line in a direction perpendicular to the lengthwise direction of movement of the ink cup.

13. Apparatus according to claim 12 further comprising an annulus being provided in and extending inwardly from the bottom surface of the knob, said means for preventing rotation of the ink cup comprising a plurality of openings being provided in the inner end of the top member of the translation means, and a plurality of openings being provided in the closed top end of the ink cup in opposition to the plurality of openings in the top member of the translation means, and an elongated pin having a top end and a bottom end being provided and inserted into one of the said plurality of openings in the top member of the translation means and into one of the plurality of openings provided in the closed end of the ink cup in opposition to and in alignment therewith, the top end of the elongated pin being located in the annulus provided in the knob of the pressure adjusting means.

* * * * *